US008072754B2

(12) United States Patent
Zhang et al.

(10) Patent No.: US 8,072,754 B2
(45) Date of Patent: Dec. 6, 2011

(54) ELECTRONIC DEVICE INCORPORATING CENTRIFUGAL BLOWER

(75) Inventors: Qiang Zhang, Shenzhen (CN); Chien-Long Hong, Taipei Hsien (TW); Yung-Ping Lin, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 41 days.

(21) Appl. No.: 12/748,439

(22) Filed: Mar. 28, 2010

(65) Prior Publication Data

US 2011/0149511 A1 Jun. 23, 2011

(30) Foreign Application Priority Data

Dec. 21, 2009 (CN) ..... 2009 1 0311946

(51) Int. Cl.
*H05K 7/20* (2006.01)

(52) U.S. Cl. ..... 361/695; 361/694; 361/720; 165/122; 174/16.1; 415/206; 415/213.1

(58) Field of Classification Search ..... None
See application file for complete search history.

(56) References Cited

U.S. PATENT DOCUMENTS

| | | | | |
|---|---|---|---|---|
| 5,223,997 | A * | 6/1993 | Uemura et al. | 360/234.6 |
| 6,781,835 | B2 * | 8/2004 | Hashimoto et al. | 361/697 |
| 7,708,521 | B2 * | 5/2010 | Hwang et al. | 415/203 |
| 7,864,525 | B2 * | 1/2011 | Chen et al. | 361/695 |
| 7,930,071 | B2 * | 4/2011 | Nishizawa et al. | 700/304 |
| 7,948,750 | B2 * | 5/2011 | Hung et al. | 361/679.47 |
| 2008/0043436 | A1 * | 2/2008 | Hung et al. | 361/700 |
| 2009/0290307 | A1 * | 11/2009 | Hwang et al. | 361/695 |

* cited by examiner

*Primary Examiner* — Boris Chervinsky
(74) *Attorney, Agent, or Firm* — Altis Law Group, Inc.

(57) ABSTRACT

An electronic device includes a casing, a centrifugal blower and sidewall received in the casing. The casing is adapted for accommodating electronic components therein, and includes a bottom cover and an opposite top cover. The centrifugal blower is surrounded by the sidewall and includes a sleeve directly mounted to the bottom cover, a bearing member mounted in the sleeve, a stator mounted to the sleeve and an impeller rotatably supported by the bearing member. The bottom cover of the electronic device functions as a bottom plate of the centrifugal blower.

16 Claims, 4 Drawing Sheets

ELECTRONIC DEVICE INCORPORATING CENTRIFUGAL BLOWER

BACKGROUND

1. Technical Field

The disclosure generally relates to electronic devices, and particularly to an electronic device incorporating a centrifugal blower.

2. Description of Related Art

With the continuing development of electronic technology, processors of electronic devices such as notebook computers or Digital Video Disc (DVD) players have become very fast and powerful. Such processors generate considerably more heat than previously. Centrifugal blowers are traditionally disposed in electronic devices to transfer heat generated by the processor to the outside environment, and thus help maintain the stability and normal operation of the electronic device.

The centrifugal blower commonly includes a housing, and an impeller rotatably received in the housing. The housing includes a top plate, a bottom plate parallel to the top plate, and a sidewall interconnecting the top plate and the bottom plate. An air inlet/inlets is defined in the top plate or/and the bottom plate corresponding to the impeller, and an air outlet is defined in the sidewall. A gap is defined between a casing of the electronic device and the top plate/bottom plate of the centrifugal blower, for allowing air to flow into the centrifugal blower smoothly. However, the gaps between the casing and top plate/bottom plate of the centrifugal fan decreases a height of an inner space of the electronic device available for mounting the centrifugal blower. This typically means that a thickness of the electronic device needs to be increased, in order to enlarge the inner space. In addition, the bottom plate of the centrifugal blower further adds to the thickness of the electronic device needing to accommodate the centrifugal blower. Such increases in the thickness of the electronic device conflict with the general requirement that portable electronic devices be lightweight, thin, compact and miniaturized.

What is needed, therefore, is an electronic device with a centrifugal blower which overcomes the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
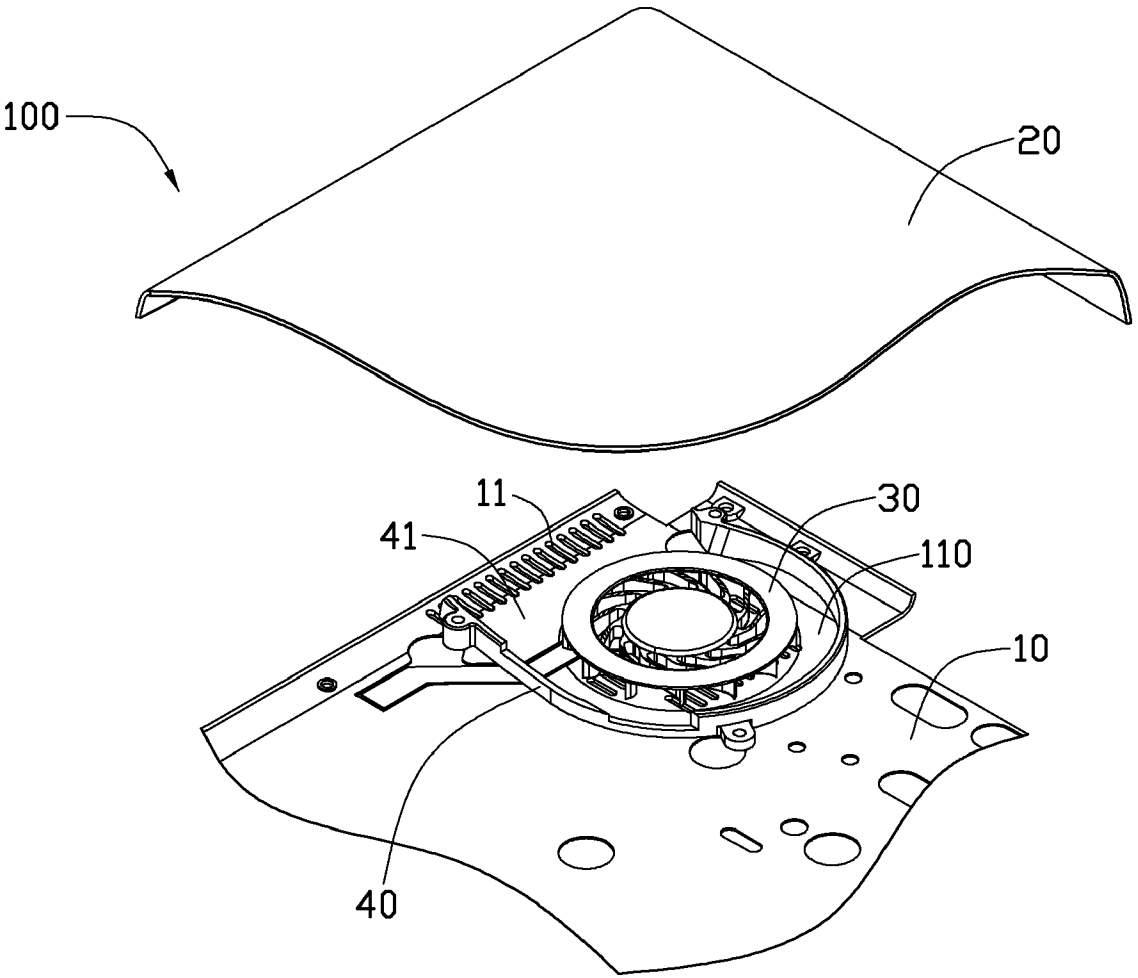
FIG. 1 is an exploded, isometric view of part of an electronic device in accordance with an exemplary embodiment of the present disclosure, showing a top cover, and a bottom cover having various components.

Referring to FIG. 1, an electronic device 100 according to an exemplary embodiment of the present disclosure is shown.

The electronic device 100 includes a bottom cover 10, a top cover 20 and a centrifugal blower 30. The top cover 20 is arranged on and connected to the bottom cover 10. The bottom cover 10 and the top cover 20 cooperatively form a casing for receiving components of the electronic device 100. Such components include a mainboard, a central processing unit (CPU) and the centrifugal blower 30. The electronic device 100 can be a notebook computer, a portable DVD player, etc. In this embodiment, the electronic device 100 is a notebook computer. However, a display panel which is pivotably connected to the casing of the electronic device 100 is not shown.

Figure 2:
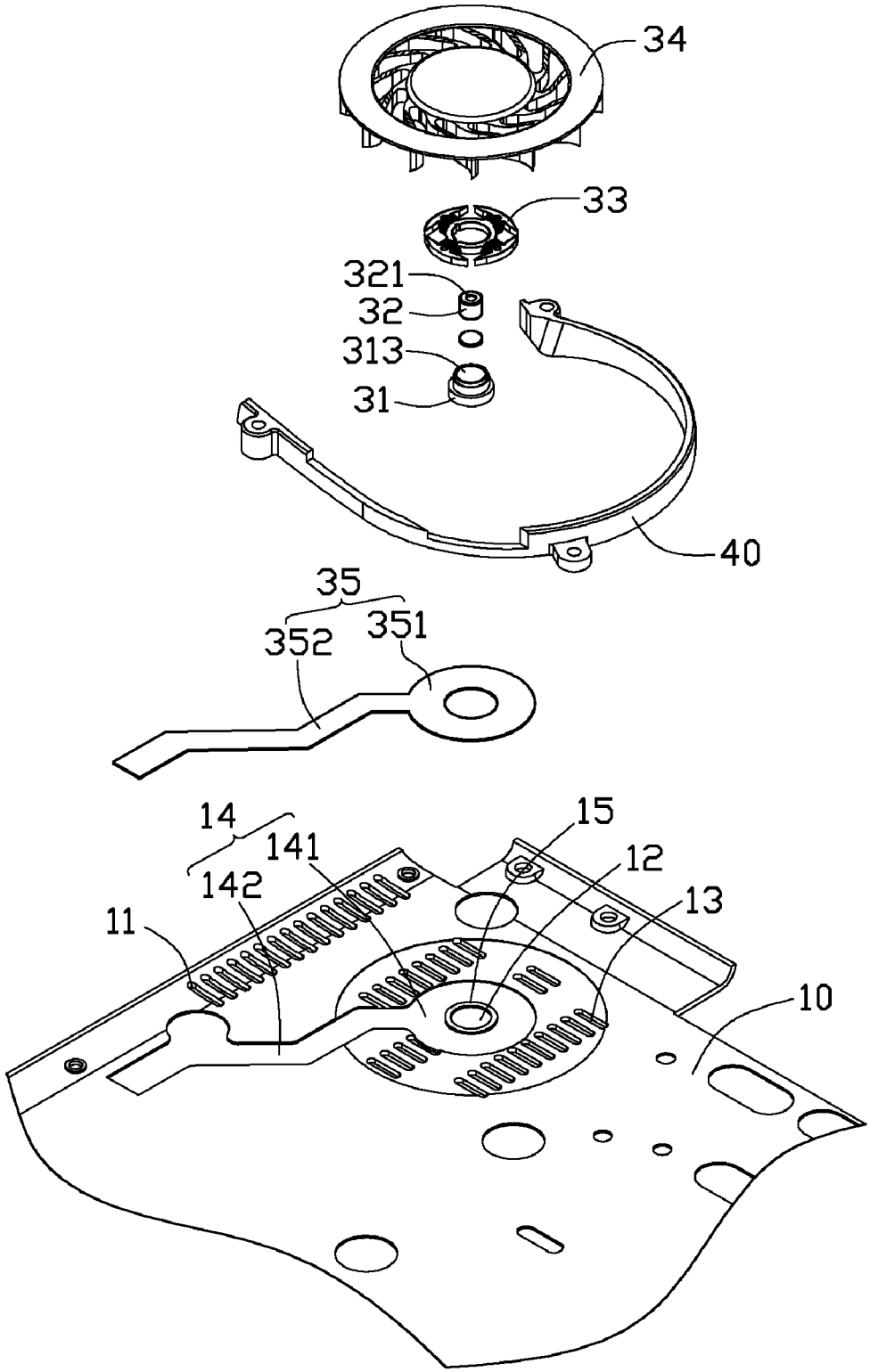
FIG. 2 is an exploded view of the bottom cover and the components thereof shown in FIG. 1, the components including a centrifugal blower having a sleeve.

Referring also to FIG. 2, the centrifugal blower 30 includes a sleeve 31, a bearing member 32 received in the sleeve 31, a stator 33, an impeller 34 and a circuit board 35.

Figure 3:
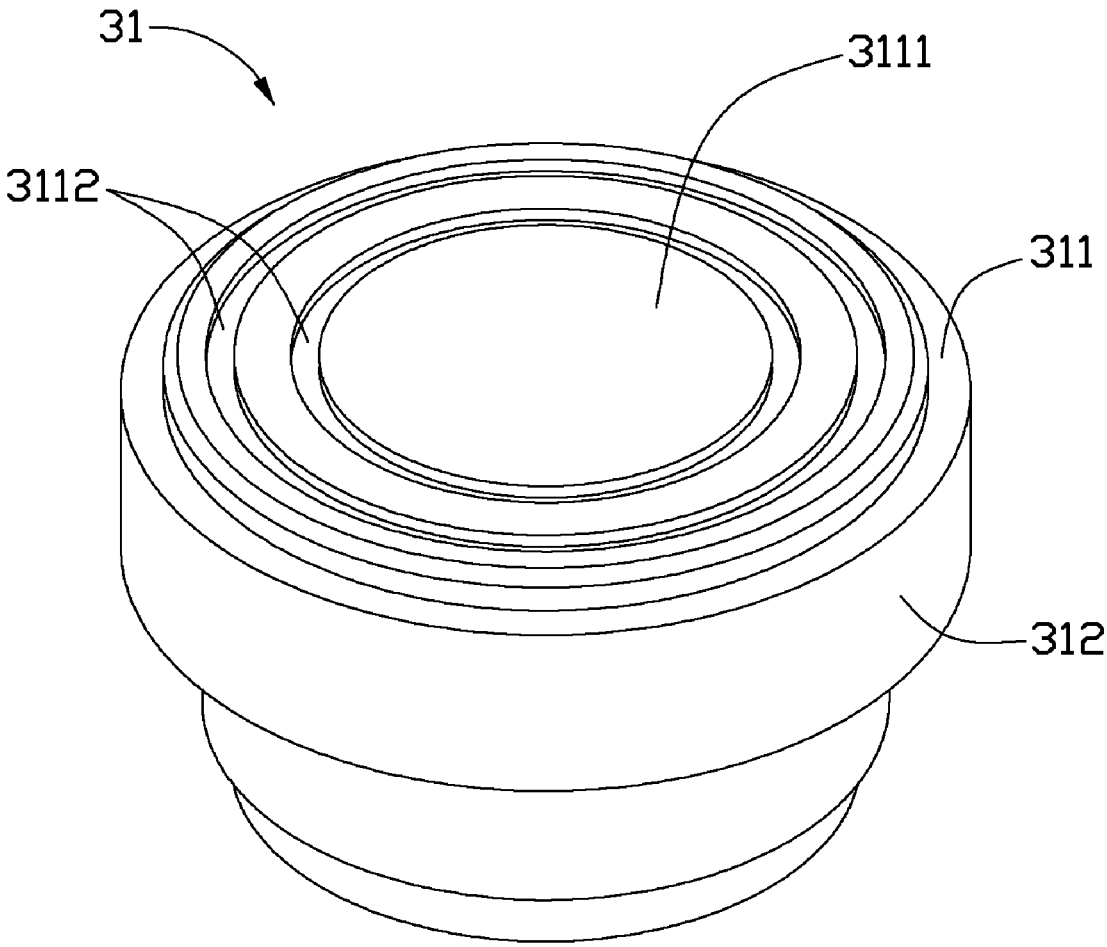
FIG. 3 is an inverted, enlarged view of the sleeve of the centrifugal blower shown in FIG. 2.
Figure 4:
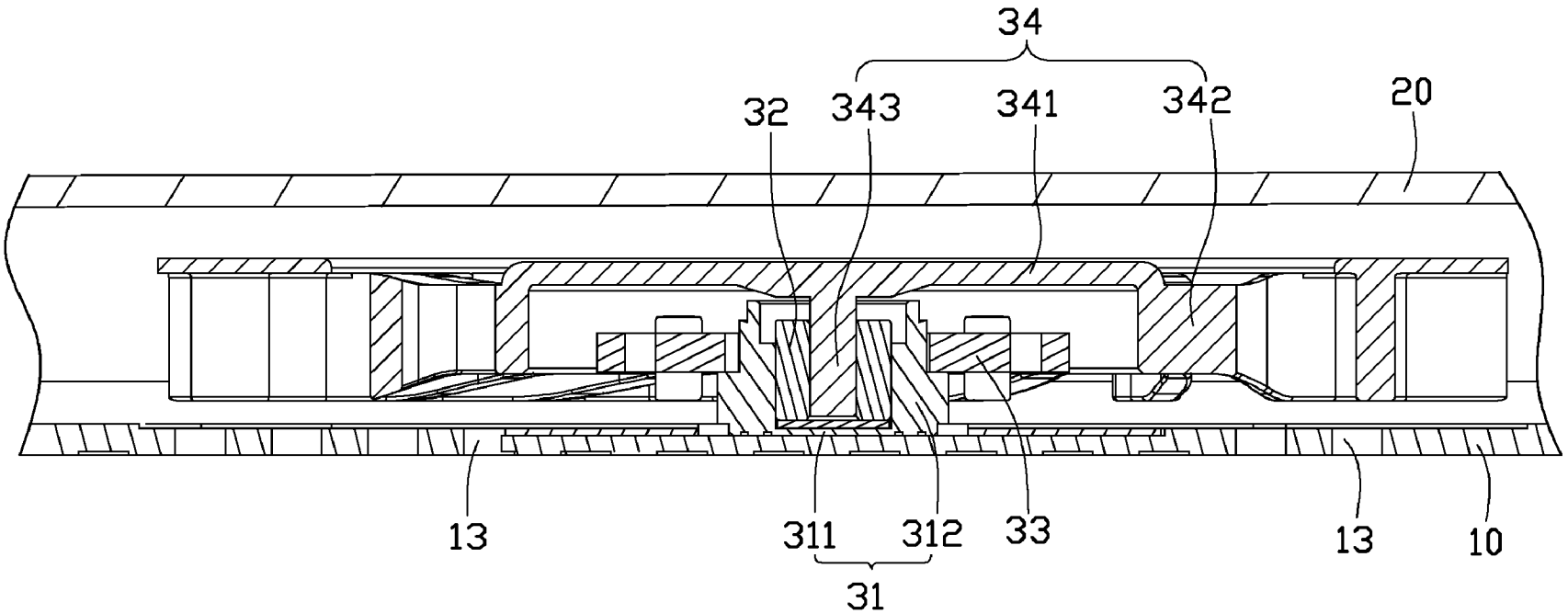
FIG. 4 is a side, cross-sectional view of the electronic device of FIG. 1 after the electronic device has been assembled.

The sleeve 31 is made of hard material such as hard metal or high strength plastic. Preferably, the sleeve 31 is made of copper or copper alloy. The sleeve 31 is used for receiving the bearing member 32 therein and supporting the stator 33 thereon. Referring also to FIGS. 3-4, the sleeve 31 is a hollow cylinder, and has a generally U-shaped cross section. A bottom end of the sleeve 31 is closed. The sleeve 31 includes a circular end plate 311, and an annular wall 312 extending upwards and vertically from a peripheral edge of the end plate 311. The end plate 311 has a fixing portion 3111 at a bottom end thereof. The fixing portion 3111 is a cylindrical protrusion. The protrusion defines two adhesive overflow grooves 3112 in an end surface thereof. The two adhesive overflow grooves 3112 are annular and concentric. The sleeve 31 axially defines a receiving hole 313 therein. A top end of the receiving hole 313 is open, and a bottom end of the receiving hole 313 is sealed by the end plate 311. The bearing member 32 is mounted in the receiving hole 313 of the sleeve 31. The bearing member 32 defines an axial hole 321 in a center thereof. The stator 33 is mounted to and around a top end of the sleeve 31.

The impeller 34 includes a hub 341, and a plurality of blades 342 extending radially and outwardly from the hub 341. A shaft 343 extends downwardly from a center of a bottom of the hub 341.

The circuit board 35 is flexible, and includes an annular portion 351 and a strip portion 352 extending from an outer edge of the annular portion 351. The circuit board 35 is electrically connected to a coil of the stator 33.

Referring back to FIGS. 1-2, the centrifugal blower 30 is disposed on the bottom cover 10, adjacent to a corner of the bottom cover 10. A volute sidewall 40 is arranged on the bottom cover 10, at the corner of the bottom cover 10. The bottom cover 10 and the sidewall 40 cooperatively define a receiving room 110 for receiving the centrifugal blower 30. As viewed from a top side, the sidewall 40 is substantially C-shaped, and defines a linear opening 41 in a left side thereof adjacent to a left edge of the bottom cover 10. The opening 41 of the sidewall 40 functions as an air outlet of the centrifugal blower 30. A fin assembly (not shown) can be provided at the opening 41 of the sidewall 40. The fin assembly can be thermally connected to an electronic component such as a CPU of the electronic device 100 via a heat conducting member such as a heat pipe, thereby transferring heat of the electronic component to the fin assembly. The bottom cover 10 defines a plurality of air exhausting apertures 11 at an outside of the opening 41 of the sidewall 40.

The bottom cover 10 has a positioning portion 12 located within the sidewall 40. The positioning portion 12 is a circular blind hole for receiving the fixing portion 3111 of the sleeve 31. The bottom cover 10 defines a plurality of elongated air intakes 13 in a portion thereof surrounded by the sidewall 40. Thus exterior air can enter the receiving room 110 via the air intakes 13. The bottom cover 10 further defines a receiving groove 14 therein. The receiving groove 14 includes an annular portion 141 surrounding the positioning portion 12, and a strip portion 142 extending from the annular portion 141. The bottom cover 10 still further defines an annular protrusion 15, which is formed between the positioning portion 12 and the annular portion 141 of the receiving groove 14.

Referring to FIGS. 1 and 4, in assembly of the centrifugal blower 30 to the bottom cover 10, the fixing portion 3111 of the sleeve 31 is received in the positioning portion 12 of the bottom cover 10. The fixing portion 3111 is adhered to the bottom cover 10 to fix the sleeve 31 on the bottom cover 10. The circuit board 35 is received in the receiving groove 14 of the bottom cover 10, with the annular portion 351 of the circuit board 35 surrounding the annular protrusion 15. The stator 33 is mounted on the sleeve 31. The bearing member 32 is mounted in the receiving hole 313 of the sleeve 31. The shaft 343 is rotatably received in the axial hole 321 of the bearing member 32 for mounting the impeller 34 to the sleeve 31.

In the assembly process of the centrifugal blower 30, the sleeve 31 is adhered to the bottom cover 10 by: dispensing one or more drops of adhesive onto the positioning portion 12 of the bottom cover 10, coating a layer of activator on the fixing portion 3111 of the sleeve 31, and pressing the fixing portion 3111 into the positioning portion 12 of the bottom cover 10. The adhesive can quickly and tightly adhere the fixing portion 3111 to the bottom cover 10 under the action of the activator. The adhesive overflow grooves 3112 defined in the end surface of the fixing portion 3111 of the sleeve 31 are used for accommodating any surplus adhesive therein, thereby allowing the fixing portion 3111 of the sleeve 31 to adhere to the bottom cover 10 more firmly.

During operation of the centrifugal blower 30, the impeller 34 rotates to generate forced airflow. Air in the ambient environment can be drawn into the receiving room 110 through the air intakes 13 of the bottom cover 10. Then the air is driven by the impeller 34 to the opening 41 of the sidewall 40 to exchange heat with the fin assembly, and finally flows out of the casing of the electronic device 100 through the air exhausting apertures 11 for dissipating heat to the ambient environment.

In this embodiment, the sleeve 31, which is used for receiving the bearing member 32 and supporting the stator 33, is a separate component and is directly fixed on the bottom cover 10 of the electronic device 100. The bottom cover 10 of the electronic device 100 functions as a bottom plate of the centrifugal blower 30. Thus the bottom plate of a conventional blower is not needed in the present centrifugal blower 30, and a height of the space occupied by the centrifugal blower 30 is reduced. Therefore the electronic device 100 incorporating the above-mentioned centrifugal blower 30 is thin. That is, the electronic device 100 can fulfill the trend toward miniaturization of electronic devices.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electronic device, comprising:

a casing adapted for accommodating electronic components therein and comprising a bottom cover and an opposite top cover;

a sidewall received in the casing, the sidewall being arranged on and perpendicularly to the bottom cover of the casing; and a centrifugal blower received in the casing and surrounded by the sidewall, the centrifugal blower comprising:

a sleeve directly mounted to the bottom cover, the bottom cover of the electronic device functioning as a bottom plate of the centrifugal blower;

a bearing member mounted in the sleeve;

a stator mounted to the sleeve; and an impeller rotatably supported by the bearing member;

wherein the centrifugal blower further comprises a flexible circuit board, the circuit board being attached to the bottom cover.

2. The electronic device of claim 1, wherein the sleeve includes an end plate and an annular wall extending upwardly from a peripheral edge of the end plate, the sleeve having a fixing portion at a bottom end of the end plate, the bottom cover having a positioning portion corresponding to the fixing portion of the sleeve, the fixing portion of the sleeve being firmly fixed to the positioning portion of the bottom cover.

3. The electronic device of claim 2, wherein the fixing portion of the sleeve is fixed to the positioning portion of the bottom cover via adhesive.

4. The electronic device of claim 2, wherein the fixing portion of the sleeve defines at least one adhesive overflow groove therein.

5. The electronic device of claim 2, wherein the fixing portion of the sleeve is a protrusion, the positioning portion of the bottom cover is a blind hole, and the protrusion is received in the blind hole.

6. The electronic device of claim 1, wherein the sidewall is generally C-shaped and has an opening facing an edge of the bottom cover.

7. The electronic device of claim 6, wherein the bottom cover defines a plurality of air exhausting apertures at an out side of the opening of the sidewall.

8. The electronic device of claim 1, wherein the bottom cover defines a plurality of elongated air intakes in a portion of the bottom cover surrounded by the sidewall.

9. The electronic device of claim 1, wherein the bottom cover defines a receiving groove therein, the circuit board of the centrifugal blower being received in the receiving groove of the bottom cover.

10. An electronic device, comprising:

a casing adapted for accommodating electronic components therein and comprising a bottom cover and an opposite top cover;

a centrifugal blower received in the casing, the centrifugal blower comprising:

a sleeve directly mounted to the bottom cover, the bottom cover of the electronic device functioning as a bottom plate of the centrifugal blower;

a stator mounted to the sleeve; and an impeller rotatably supported by the sleeve; and a sidewall received in the casing and arranged on the bottom cover of the casing, the sidewall surrounding the centrifugal blower and defining an air outlet therein;

wherein the centrifugal blower further comprises a flexible circuit board, the circuit board being attached to the bottom cover.

11. The electronic device of claim 10, wherein the sleeve includes an end plate and an annular wall extending upwardly from a peripheral edge of the end plate, the sleeve having a fixing portion at a bottom end of the end plate, the bottom cover having a positioning portion corresponding to the fixing portion of the sleeve, the fixing portion of the sleeve being firmly fixed to the positioning portion of the bottom cover.

12. The electronic device of claim 11, wherein the fixing portion of the sleeve is fixed to the positioning portion of the bottom cover via adhesive.

13. The electronic device of claim 11, wherein the fixing portion of the sleeve defines at least one adhesive overflow groove therein.

14. The electronic device of claim 11, wherein the fixing portion of the sleeve is a protrusion, the positioning portion of the bottom cover is a blind hole, and the protrusion is received in the blind hole.

15. The electronic device of claim 10, wherein the bottom cover defines a plurality of elongated air intakes in a portion of the bottom cover surrounded by the sidewall.

16. The electronic device of claim 10, wherein the bottom cover defines a receiving groove therein, the circuit board of the centrifugal blower being received in the receiving groove of the bottom cover.

* * * * *